US005195910A

United States Patent [19]

Enomoto et al.

[11] Patent Number: 5,195,910

[45] Date of Patent: Mar. 23, 1993

[54] COAXIAL CONNECTOR

[75] Inventors: Hideyuki Enomoto; Ikujiro Mitani, both of Tokyo, Japan

[73] Assignees: NEC Corporation; Hirose Electric Co., Ltd., Tokyo, Japan

[21] Appl. No.: 641,269

[22] Filed: Jan. 15, 1991

[30] Foreign Application Priority Data

Jan. 16, 1990 [JP] Japan ..... 2-2877[U]

[51] Int. Cl.[5] ..... H01R 17/04

[52] U.S. Cl. ..... 439/578; 439/874

[58] Field of Search ..... 439/578-585, 439/675, 874

[56] References Cited

U.S. PATENT DOCUMENTS

| | | | |
|---|---|---|---|
| 4,545,637 | 10/1985 | Bosshard et al. | 439/874 |
| 4,688,876 | 8/1987 | Morelli | 439/578 |
| 4,698,028 | 10/1987 | Caro et al. | 439/578 |
| 4,772,223 | 9/1988 | Yasumoto | 439/578 |
| 4,906,207 | 3/1990 | Banning et al. | 439/578 |

FOREIGN PATENT DOCUMENTS

| | | | |
|---|---|---|---|
| 2211674 | 4/1989 | United Kingdom | 439/578 |

*Primary Examiner*—David L. Pirlot

*Attorney, Agent, or Firm*—Leydig, Voit & Mayer

[57] ABSTRACT

A coaxial connector for use in connecting a first coaxial cable having a terminal processed in advance, to a second cable. The first cable comprises a central conductor, an insulator surrounding the conductor, a braid surrounding the insulator for shielding the same, and a sheath surrounding the braid for protecting the same. The coaxial connector comprises a sleeve section having an inner peripheral surface in close contact with an outer peripheral surface of the sheath, and a shell section integral with the sleeve section in coaxial relation thereto. A plurality of soldering bores are formed in the shell section and cooperate with each other to form passageway through which molten solder can pass to fill up an annular gap formed between an outer peripheral surface of the braid and an inner peripheral surface of the shell section. The coaxial connector may further comprise at least one cable-sheath viewing bore which is formed in the sleeve section and one can view the presence of the sheath through the viewing bore.

12 Claims, 3 Drawing Sheets

COAXIAL CONNECTOR

BACKGROUND OF THE INVENTION

The present invention relates to a coaxial connector such as an SMA type connector or the like.

The prior art will first be described with reference to FIGS. 3, 4(*a*) and 4(*b*) of the attached drawings. A coaxial connector 20 according to the prior art comprises a hollow shell 4 and a caulking or staking ring 16 arranged in concentric or coaxial relation to the shell 4. That is, the shell 4 has its rearward end which is inserted into a forward end of the staking ring 16. The rearward end of the shell 4 and the forward end of the staking ring 16 are connected to each other by means of solder 11. A coupling nut 1 is fitted about the shell 4 for sliding movement therealong. An O-ring 2 and a retainer ring 3 are arranged between the coupling nut 1 and the shell 4.

The connector 20 is coupled to a matching connector (not shown) for electrically connecting a coaxial cable 14 to another cable (not shown). The cable 14 has its terminal processed in advance and comprises a central conductor 9. An annular insulator 8 surrounds the central conductor 9, with a forward end portion thereof projecting from a forward end face of the insulator 8. An annular braid 7 surrounds the annular insulator 8 for shielding the same. An annular cable sheath 6 surrounds the braid 7 for protecting the same and extends to a location short of the forward end of the braid 7.

The coaxial connector 20 further comprises a contractible tube 10 which is fitted about the staking ring 16. The contractible tube 10 has a forward end thereof which projects beyond the forward end face of the staking ring 16 and which is in contact with the outer peripheral surface of the shell 4.

The shell 4 of the connector 20 is fixedly connected to the forward end of the braid 7 of the cable 14 through a solder 19. The cable sheath 6 of the cable 14 is covered by the staking ring 16 with an annular gap 15 left between the inner peripheral surface of the staking ring 16 and the outer peripheral surface of the cable sheath 6.

With the above-described arrangement of the prior art connector 20, the cable 14 is soldered to the shell 4 by the solders 11 and 19 and, subsequently, the rearward end of the shell 4 is staked by the staking ring 16. Thus, it is by the staking that mechanical strength at the connection between the coaxial cable 14 and the connector 20 is maintained or raised.

However, the prior art connector 20 has the following drawbacks or disadvantages. That is, there are required a step of inserting the cable 14 into the staking ring 16 and a step of staking the latter to the cable 14. Thus, working steps increase. Further, since the staking ring 16 stakes the rearward end of the shell 4 from its outer surface, the gap 15 occurs between the cable sheath 6 and the staking ring 16, so that the cable 14 cannot be fixed to the staking ring 16 and it is impossible to securely hold the cable 14. Thus, the cable 14 may be broken or disconnected.

SUMMARY OF THE INVENTION

It is, therefore, an object of the invention to provide an improved coaxial connector which overcome the above described defects existing in the conventional coaxial connector.

It is another object of the invention to provide a coaxial connector that improves cable assembly efficiency.

It is a further object of the invention to provide a coaxial connector with improved mechanical strength at the connection between the coaxial connector and a cable.

Accordingly, the present invention provides a coaxial connector comprising a shell section and a sleeve section which is coaxially connected to the shell section. The shell section has a shell central bore which receives a braided portion of a coaxial cable. The shell section also has at least two soldering holes. The sleeve section has a sleeve central bore which receives an insulating sheath portion of the coaxial cable, the sleeve central bore being larger than the shell central bore. The sleeve section also has a cable sheath viewing hole allowing the presence of the sheath to be conformed. The cable sheath viewing hole is axially displaced from the soldering holes.

The present invention also provides a coaxial connector which comprises a sleeve section and a shell section which is integral with and coaxial to the sleeve section. The sleeve section has an interperipheral surface in close contact with the outer peripheral surface of the sheath of a cable. The sleeve section also has one viewing bore through which the presence of the sheath may be viewed. The shell section also has an interperipheral section and a smaller interdiameter than the sleeve section. The shell section also has at least two soldering bores arranged peripherally around the shell section and axially displaced from the viewing bore. The soldering bores cooperate with each other to form a passage through which molten solder can pass to fill up an annular gap formed between the outer peripheral surface of a braid of the cable and the interperipheral surface of shell section, the molten solder being solidified to connect the braid to the shell section.

The invention further provides an apparatus for connecting a coaxial cable, the apparatus comprising a single-monolithic coaxial connector piece which includes a shell portion and a sleeve portion. The shell portion has a shell central bore which receives a braided portion of a coaxial cable. At least two soldering holes are formed in the shell portion. The sleeve portion is adjacent and coaxial to the shell portion and has a sleeve central bore for receiving and insulating the sheath portion of the coaxial cable. The sleeve central bore is larger than the shell central bore. The sleeve portion also has a viewing bore through which the presence of the sheath may be viewed, the viewing bore being axially displaced from the soldering holes. The apparatus further comprises a coupling nut rotatably mounted to the shell portion of the coaxial connector piece.

In addition, the present invention provides a method for attaching a coaxial cable to a coaxial cable connector comprising the steps of inserting a previously processed end terminal of a coaxial cable into a single coaxial connector piece having a first portion with a first diameter bore and a second with a smaller second diameter bore. Inserting the cable includes inserting an insulating sheath portion of the coaxial cable into the first diameter bore until the sheath portion appears through a viewing port in the first portion and inserting a braided portion of the coaxial cable into the second diameter bore. The method further includes the step of soldering the braided portion of the coaxial cable to the single coaxial connector piece by flowing solder to at least two soldering holes provided in the second portion of the connector piece, the soldering holes being axially displaced from viewing port. Further, the method comprises rotatably mounting a connecting nut to the portion of the single coaxial connector piece having the first diameter bore.

As described above, the coaxial connector according to the invention is arranged such that the shell section is integral with the sleeve section and is arranged in coaxial relation thereto, the second opening means is formed in the sleeve section, one being able to view the presence of the sheath through the second opening means, and a plurality of first opening means are formed in the shell section, the first opening means cooperating with each other to form the passage means through which the molten solder can pass. Thus, an achievement can be made to reduce the cable assembling steps, and to improve the mechanical strength at the connection between the connector and the cable.

BRIEF DESCRIPTION OF THE DRAWINGS

The above and other objects, features and advantages of the present invention will be apparent from the following description of preferred embodiments of the invention, with reference to the accompanying drawings, in which:

FIG. 4(*b*) is a perspective view of the connector and the cable illustrated in FIG. 4(*a*), with the staking ring fitted about a rearward end of the shell.

PREFERRED EMBODIMENT OF THE INVENTION

Figure 1:
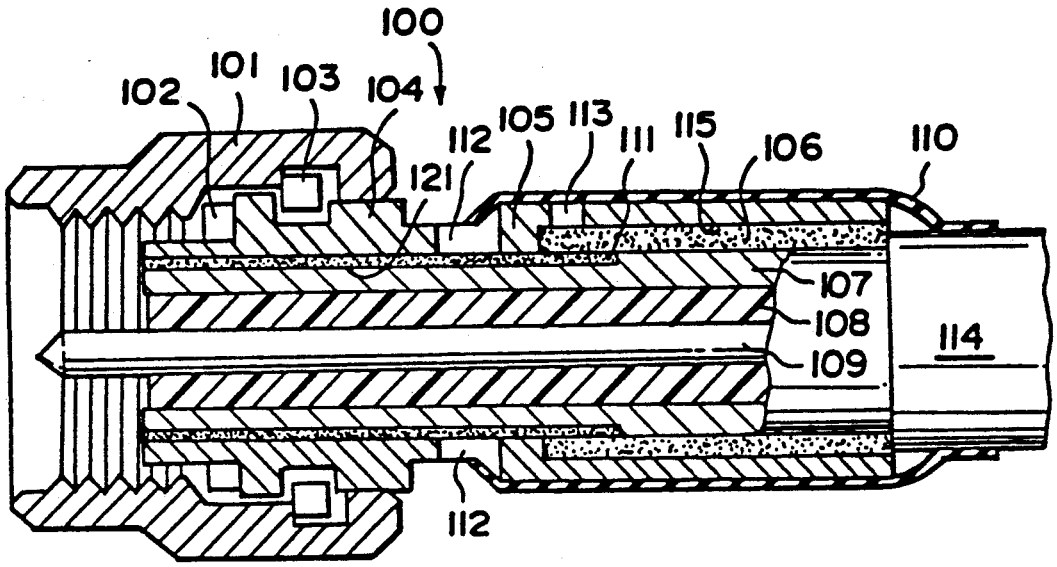
FIG. 1 is a longitudinal cross-sectional view of a coaxial connector according to an embodiment of the invention.
Figure 2:
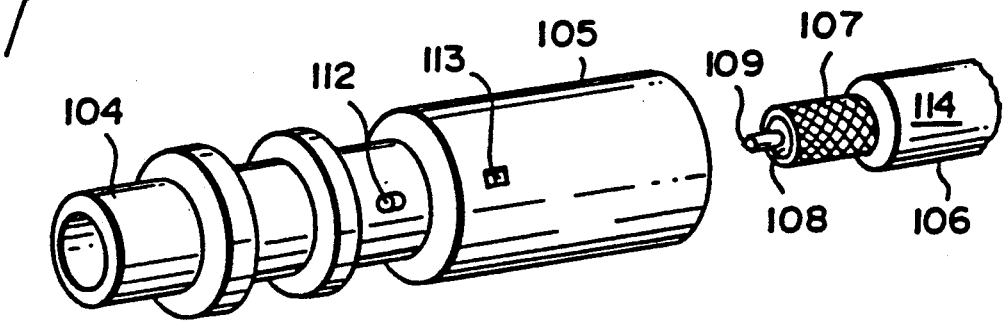
FIG. 2 is a perspective view of the coaxial connector and a forward end of a cable illustrated in FIG. 1, with a coupling nut omitted.

Referring to FIGS. 1 and 2, there is shown a coaxial connector 100 of the invention for use in connecting a first cable 114 to a second cable (not shown). The second cable is known well and is not illustrated. The first cable 114 has its terminal processed in advance. The first cable 114 comprises a central conductor 109, and an annular insulator 108 surrounding the central conductor 109, with a forward end portion thereof projecting from a forward end of the insulator 108. The first cable 114 further comprises an annular braid 107 surrounding the insulator 108 for shielding the same, and an annular cable sheath 106 surrounding the braid 107 for protecting the same. The cable sheath 106 extends to a location short of the forward end of the braid 107.

The coaxial connector 100 comprises a sleeve section 105 which has an inner peripheral surface in close contact with an outer peripheral surface of the cable sheath 106. A shell section 104 is integral and monolithic with the sleeve section 105 and is arranged in coaxial relation thereto. The shell section 104 is located adjacent to a forward end of the first cable 114, with the sleeve section 105 located between the shell section 104 and the remainder of the first cable 114. A coupling nut 101 is fitted about the shell section 104 for sliding movement therealong.

A central bore 121 is formed which extends through the sleeve section 105 and the shell section 104, for receiving the braid 107, the insulator 108 and the central conductor 109 of the cable 114. A bore 115 for receiving the cable sheath 106 of the cable 114 is formed in the sleeve section 105 in coaxial relation to the aforementioned bore 121 and has an inner diameter larger than that of the bore 121.

At least one cable-sheath viewing bore 113 is formed in the sleeve section 105 adjacent to the shell section 104 and communicates with the bore 115. One can view or confirm the presence of the sheath 106 through the cable-sheath viewing bore 113.

A plurality of soldering bores 112 are formed in the shell section 104 and are arranged peripherally thereof. The soldering bores 112 are located at the connection between the shell section 104 and the sleeve section 105 and, as shown in FIG. 1, are axially displaced from the cable-sheath viewing bore 113. The soldering bores 112 cooperate with each other to form a passage through which molten solder can pass to fill up an annular gap formed between an outer peripheral surface of the braid 107 and an inner peripheral surface of the shell section 104. The molten solder is cooled and solidified to form solder 111 which connects the braid 107 to the shell section 104.

The coaxial connector 100 further comprises a contractible tube 110 which is fitted about the sleeve section 105. The contractible tube 110 has a forward end thereof which partially covers the soldering bores 112.

Executing steps of procedure of the coaxial connector 100 arranged as described above will next be described.

Figure 3:
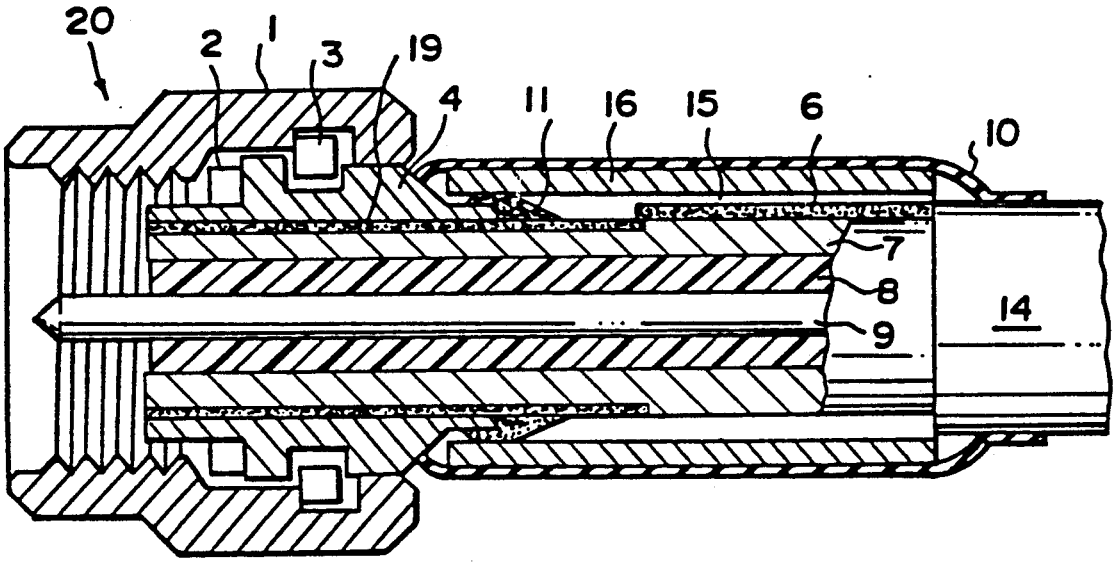
FIG.3 PRIOR ART
FIG. 3 is a longitudinal cross-sectional view of the prior art coaxial connector.
Figure 4A:
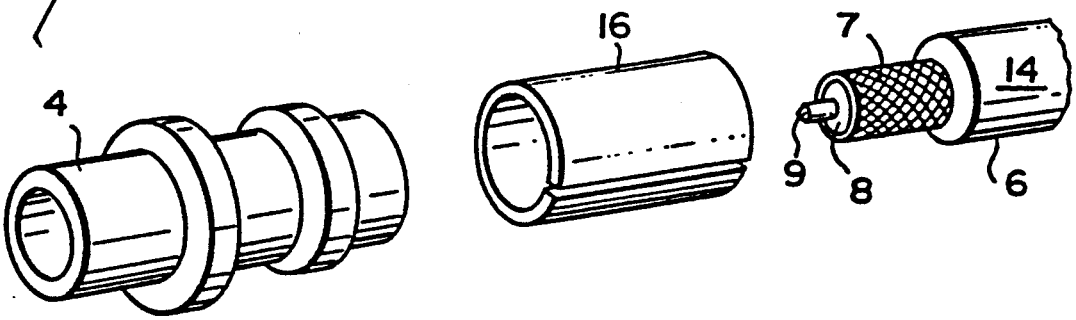
FIG.4(a) PRIOR ART
FIG. 4(*a*) is a perspective view of a shell and a staking ring of the connector, and a forward end of a cable illustrated in FIG. 3.
Figure 4B:
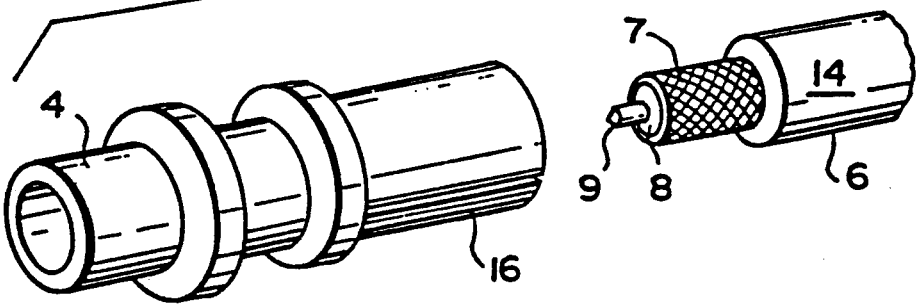
FIG.4(b) PRIOR ART

First, the cable 114 having its terminal processed in advance is inserted into the connector 100. An operator views the cable sheath 106 through the viewing bore 113 and confirms that the cable sheath 106 is located in position. After it is confirmed through the cable-sheath viewing bore 113 that the cable sheath 106 is located at the normal or regular position, the shell section 104 is heated as a whole. Thin solder in the form of thread is inserted successively through the plurality of soldering bores 112 to form the solder 111 for soldering the connector 100 and the braid 107 to each other. By doing so, since the cable 114 having its terminal processed in advance is merely inserted into the shell 104, it is possible to omit a step of inserting the cable 114 into the staking ring 6 of the prior art connector 20 described previously with reference to FIGS. 3, 4(*a*) and 4(*b*), and also a step of staking the staking ring 6 to the cable 114. Thus, it is possible to reduce steps required for assembling the cable 114 into the connector 100. Further, the inner diameter of the connector 100 is brought to a value substantially in agreement with the outer diameter of the cable 114. Accordingly, no annular gap occurs between the sleeve section 105 and the cable sheath 106, unlike in the conventional connector 20. Thus, it is possible to improve the mechanical strength at the connection between the cable 114 and the connector 100.

While the invention has been described in its preferred embodiment, it is to be understood that the words which have been used are words of description rather than limitation and that changes within the purview of the appended claims may be made without departing from the true scope and spirit of the invention in its broader aspects.

What is claimed is:

1. A coaxial connector for use in connecting a first cable having a terminal processed in advance, to a second cable, said first cable comprising a central conductor, an insulator surrounding said conductor, a braid surrounding and shielding said insulator and having an outer peripheral surface, and a sheath surrounding and protecting said braid and having an outer peripheral surface, said coaxial connector comprising:

a sleeve section having an inner peripheral surface in close contact with said outer peripheral surface of said sheath;

a shell section integral with said sleeve section in coaxial relation thereto and having a smaller inner diameter than the sleeve section and an inner peripheral surface; and at least one viewing bore formed in said sleeve section through which the presence of said sheath may be viewed and a plurality of soldering bores formed in said shell section and arranged peripherally thereof and axially displaced from said viewing bore, said plurality of soldering bores cooperating with each other to form passage means through which molten solder can pass to fill up an annular gap form between said outer peripheral surface of said braid and said inner peripheral surface of said shell section, said molten solder being solidified to connect to said braid to said shell section.

2. The coaxial connector according to claim 1, wherein said plurality of soldering bores are located at the connection between said shell section and sleeve section.

3. The coaxial connector according to claim 1, wherein said shell section is located adjacent to a forward end of said first cable, with said sleeve section located between said shell section and the remainder of said first cable.

4. The coaxial connector according to claim 1, further comprising a coupling nut fitted about said shell section for sliding movement therealong, and a contractible tube fitted about said sleeve section, said contractible tube having a forward end thereof which partially covers each of said plurality of soldering bores.

5. An apparatus for connecting a coaxial cable comprising:

a single, monolithic coaxial connector piece including:

a shell portion having a shell central bore for receiving a braided portion of an external coaxial cable, and a plurality of soldering holes formed in said shell portion, and a sleeve portion, adjacent and coaxial to the shell portion, having a sleeve central bore for receiving an insulating sheath portion of the external coaxial cable, the sleeve central bore being larger than the shell central bore, and a viewing bore through which the presence of said sheath may be viewed, said viewing bore being axially displaced from said soldering holes; and a coupling nut rotatably mounted to the shell portion of said single coaxial connector piece.

6. An apparatus as recited in claim 5 wherein an inner diameter of the sleeve portion is substantially in agreement with an outer diameter of the external coaxial cable.

7. An apparatus as recited in claim 5, further comprising a contractible tube fitted over the sleeve portion, the contractible tube having a forward end which partially covers each of the plurality of soldering bores.

8. An apparatus as recited in claim 5, further comprising a cable-sheath viewing hole formed in the sleeve portion so that the presence of the insulating sheath portion can be confirmed.

9. An apparatus as recited in claim 8 wherein the cable-sheath viewing hole being formed adjacent to where the sleeve portion and the shell portion are joined.

10. A coaxial connector connecting a coaxial cable comprising:

a shell section having a shell central bore for receiving a braided portion of an external coaxial cable, and a plurality of soldering holes formed in said shell section; and a sleeve section, coaxially connected to said shell section, having a sleeve central bore for receiving an insulating sheath portion of the external coaxial cable, the sleeve central bore being larger than the shell central bore, and having a cable sheath viewing hole formed in said sheath section and axially displaced from said soldering holes so that the presence of the sheath can be confirmed.

11. A coaxial connector as recited in claim 10, wherein the cable-sheath viewing hole being formed adjacent to where said sleeve section and said shell section are coaxially connected.

12. A method for attaching a coaxial cable to a coaxial cable connector comprising the steps of:

inserting a previously processed end terminal of a coaxial cable into a single coaxial connector piece having a first portion with a first diameter bore and a second portion with a smaller second diameter bore, including inserting an insulating sheath portion of the coaxial cable into the first diameter bore until the sheath portion appears through a viewing port in the first portion to mechanically support the insulating sheath portion, and inserting a braided portion of the coaxial cable into the second diameter bore;

soldering the braided portion of the coaxial cable to the single coaxial connector piece by flowing solder through a plurality of soldering holes provided in the second portion and axially displaced from the viewing port to provide electrical and fixed connection between the coaxial cable and the single coaxial connector piece; and rotatably mounting a connecting nut to the portion of the single coaxial connector piece having the first diameter bore.

* * * * *